US006261438B1

(12) United States Patent
Haby et al.

(10) Patent No.: US 6,261,438 B1
(45) Date of Patent: Jul. 17, 2001

(54) METHOD AND APPARATUS FOR ROUGHENING A SUPPORT FOR RADIATION-SENSITIVE COATINGS

(75) Inventors: Georg Haby, Liederbach; Günter Hultzsch, Wiesbaden; Klaus Joerg, Ingelheim; Uwe Gartmann, Eltville; Jörg Kaden, Klingelbach; Hermann Idstein, Oestrich-Winkel, all of (DE)

(73) Assignee: Agfa-Gevaert NV, Mortsel (BE)

( * ) Notice: Subject to any disclaimer, the term of this patent is extended or adjusted under 35 U.S.C. 154(b) by 0 days.

(21) Appl. No.: 09/466,928

(22) Filed: Dec. 20, 1999

(30) Foreign Application Priority Data

Dec. 21, 1998 (DE) ..... 198 59 216

(51) Int. Cl.[7] ..... C25F 3/00

(52) U.S. Cl. ..... 205/659; 205/214; 204/209; 204/269

(58) Field of Search ..... 204/206, 209, 204/269; 205/205, 214, 659

(56) References Cited

U.S. PATENT DOCUMENTS

| | | | |
|---|---|---|---|
| 3,691,030 | 9/1972 | Stroszynski | 204/32 R |
| 3,851,421 | 12/1974 | Stroszynski | 51/11 |
| 3,891,516 | 6/1975 | Chu | 204/33 |
| 4,087,341 | 5/1978 | Takahashi et al. | 204/129.43 |
| 4,476,006 | 10/1984 | Ohba et al. | 204/17 |
| 4,735,696 | 4/1988 | Huang et al. | 204/129.43 |
| 4,915,800 | 4/1990 | Nakanishi et al. | 204/35.1 |
| 4,919,774 | 4/1990 | Minato et al. | 204/129.4 |
| 5,045,157 | 9/1991 | Nishino et al. | 204/33 |
| 5,082,537 | 1/1992 | Stroszynski et al. | 205/139 |
| 5,271,818 | 12/1993 | Stroszynski et al. | 204/211 |

FOREIGN PATENT DOCUMENTS

| | | |
|---|---|---|
| 19 62 729 | 12/1969 | (DE) . |
| 19 62 728 | 6/1971 | (DE) . |
| 2 130 391 | 2/1972 | (DE) . |
| 26 50 762 | 5/1977 | (DE) . |
| 30 12 135 | 10/1980 | (DE) . |
| 38 42 454 | 7/1989 | (DE) . |
| 39 10 450 | 11/1989 | (DE) . |
| 0 390 033 | 10/1990 | (EP) . |
| 0 390 033 A1 | 10/1990 | (EP) . |
| 39 10 213 | 10/1990 | (DE) . |
| 0 422 682 A2 | 4/1991 | (EP) . |
| 0 585 586 | 3/1994 | (EP) . |

OTHER PUBLICATIONS

Patent Abstracts of Japan, vol. 17, No. 100 (c–1030), Feb. 26, 1993, "Production of Support for Lithographic Printing Plate", Pub. No. 04289200, Oct. 14, 1992.

Patent Abstracts of Japan, vol. 12, No. 445 (m–767), Nov. 22, 1988, "Manufacture of Base Material for Printing Form Plate", Pub. No. 63176187, Jul. 20, 1988.

*Primary Examiner*—Kathryn Gorgos
*Assistant Examiner*—Thomas H Parsons
(74) *Attorney, Agent, or Firm*—Foley & Lardner

(57) ABSTRACT

A method and apparatus for electrochemically roughening a support is disclosed to minimize the occurrence of surface discharges or electrical discharges on the support. A DC voltage acts on the support at the start of the movement of the support through the electrolyte bath. Subsequently, a three-phase or single-phase current acts on the support in the roughening zone. Three-phase electrodes are arranged in the electrolyte bath and are connected to the secondary of a three-phase transformer. The primary of the three-phase transformer is connected, via control transformers to a three-phase power transformer. A DC electrode is located upstream of the three-phase electrodes in the direction in which the support is transported through the bath. The DC electrode may be connected to the positive pole of a DC source while the negative pole of this DC source makes contact with the support.

20 Claims, 4 Drawing Sheets

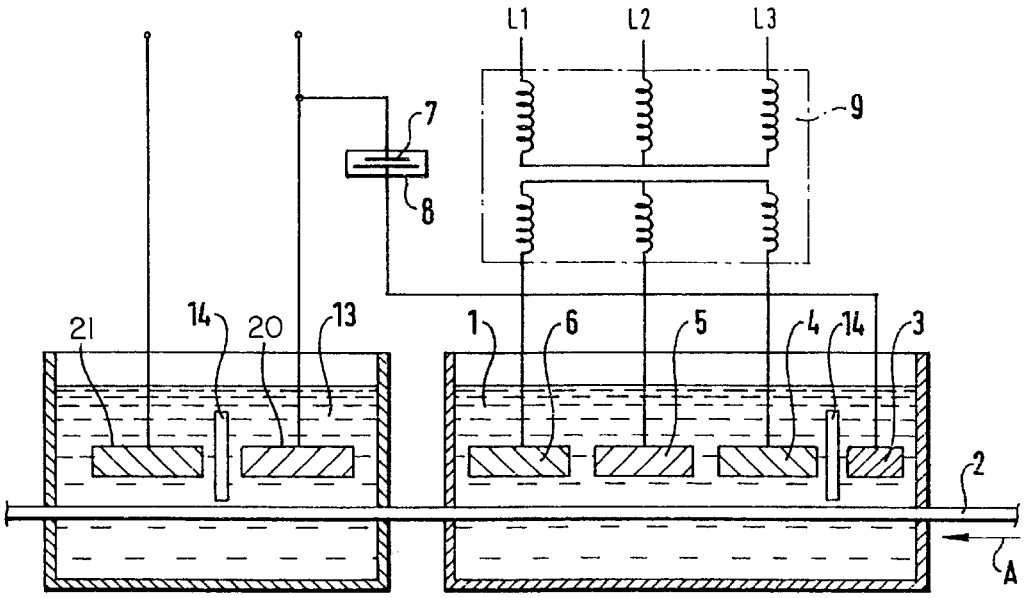
FIG. 5
FIG. 6
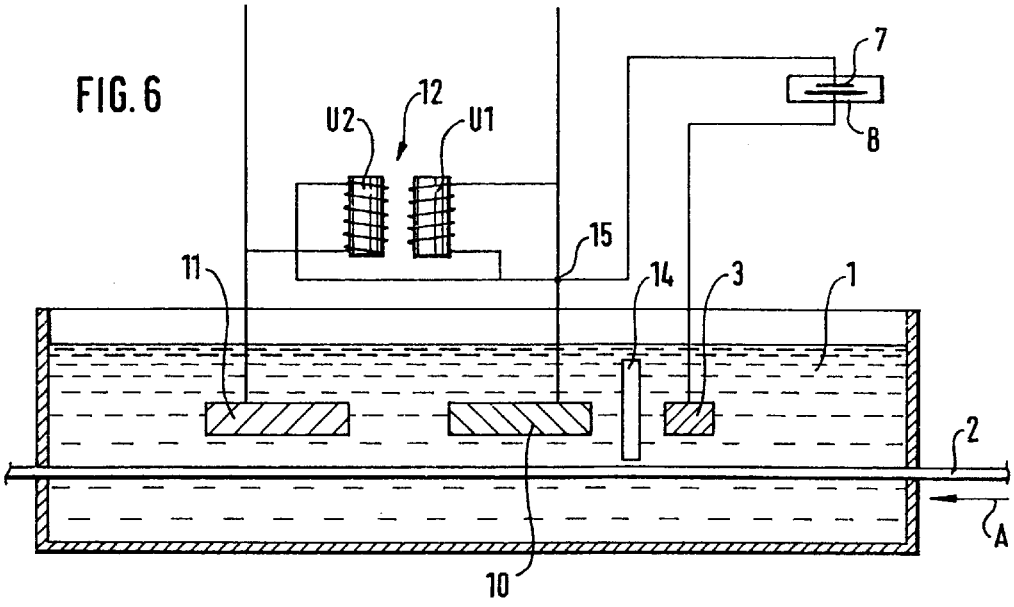

METHOD AND APPARATUS FOR ROUGHENING A SUPPORT FOR RADIATION-SENSITIVE COATINGS

BACKGROUND OF THE INVENTION

1. Field of the Invention

The invention relates to a method and an apparatus for roughening a support for radiation-sensitive coatings. The surface of the support may be roughened electrochemically or may be roughened mechanically followed by electrochemical roughening. The electrochemical roughening is performed in an aqueous electrolyte bath by applying three-phase or single-phase current to electrodes which face the support while the support is passed through the electrolyte bath.

2. Description of the Related Art

Roughened supports may be used to produce presensitized printing plates. The supports may be formed of materials which are typically processed in plate or strip form, such as a metal. Preferably the supports are formed of aluminum. The roughening of, for example, the aluminum strips to produce printing plates, for example, is typically carried out mechanically, chemically or electrochemically, or by a combination of these roughening methods. During mechanical roughening, the surface structures typically have pyramid-like shapes and are oriented differently in the longitudinal and transverse directions (anisotropy), while electrochemically roughened surfaces generally have a sponge-like structure with a large number of wells and depressions and a uniform geometry in the longitudinal and transverse directions (isotropy).

Mechanical roughening has the advantage over purely electrochemical roughening of using less specific energy per square meter of the surface of the support. However, mechanical roughening suffers from the disadvantage of an excessively coarse surface on which crystalline structures are present, in addition to the pyramid-like structures. Owing to the anisotropy of the mechanical roughening process, it is significant to the printing process whether the printing plate has been cut along or across the strip.

Mechanical roughening methods are in general granulation methods, such as wire or brush granulation, or emery grinding. Electrochemical roughening on the other hand is in general carried out by electrolytic etching in an aqueous electrolyte solution.

German Patent No. 1,962,728 describes a method for the continuous production of a lithographic surface on a metal strip by wet grinding and electrochemical treatment in an electrolyte. The electrolyte is used to wet the metal surface during grinding and the electrochemical treatment is carried out immediately following the grinding process. For this purpose, a fine-granular grinding agent is suspended in the electrolyte and the grinding-agent suspension is blasted onto the moving strip using a broad jet extending over the entire width of the metal strip. The electrolyte is, for example, an aqueous acidic or aqueous alkaline bath.

In the granulation method described in German Patent No 2,130,391, the aluminum plate is first roughened by grinding with a moist emery compound. After rinsing and possibly cleaning the plate, the granulated surface of the aluminum plate is anodized in sulfuric acid using direct current at a voltage in the range from about 10 to 20 V with a current density in the range from about 1 to 2.2 A/dm$^2$ of granulated surface. Finally, the granulated and anodised surface of the aluminum plate is treated with a priming substance in order to improve the bond between the support material and the light-sensitive coating to be applied to the surface.

German Patent No 2,650,762-B discloses a method for electrolytic granulation of aluminum substrates for lithography using a single-phase current in an electrolyte containing hydrochloric acid or nitric acid. A single-phase voltage is applied, whose anode voltage is greater than the cathode voltage and the ratio of the cathodic charge input to the anodic charge input is less than unity. The anodic half-period of the single-phase current is set to be equal to or shorter than the cathodic half-period. The diameter and the depth of the pores and holes in the surface of the aluminum substrate may be varied, as required, by selecting a suitable ratio between the cathodic and anodic charge input, governed by the voltage setting. The frequency of the regulated single-phase current is not limited to the typical single-phase frequency range, i.e., 50 to 60 Hz. However, higher frequencies result in finer pores on the granulated surface.

German Patent Specification No. 3,012,135 describes a method for producing a support for lithographic printing plates in which the surface of an aluminum plate is mechanically roughened by wet grinding. Aluminum is chemically etched away from the surface of the plate and an electrical current with a waveform which is obtained by alternately changing the polarity, is subsequently applied to the plate in an acidic aqueous solution. The anode and cathode voltages are 1 to 50 V. The ratio of the amount of charge formed with the plate as the anode to the amount of charge formed with the plate as the cathode is 0.5/1 to 1.0/1. The electrolysis is carried out such that the current density when the plate is the anode is not less than 20 A/dm$^2$ and the amount of charge formed with the plate as the anode is 200 Coulomb/dm$^2$ or less. The plate is then subjected to anodic surface oxidation.

European Patent No. 390 033 B1 describes a method for roughening a support in which the frequency of the three-phase or single-phase current is chosen to be greater than or equal to 50 Hz to 300 Hz and in which the frequency is normally set to be higher as the speed at which the support is transported through the electrolyte bath increases. For this purpose, the electrodes are connected in the electrolyte bath to the secondary of a first three-phase transformer, whose primary is connected to a three-phase power transformer via a three-phase frequency converter and control transformers. The three-phase frequency converter converts the mains frequency of this three-phase current in a range which is greater than or equal to 50 to 300 Hz, at a voltage of between 1 and 380 V, for the individual phases of the three-phase current.

German Patent No. 3,910,450 C2 describes a method for producing a printing plate support in which the printing plate support surface is electrochemically roughened in an acidic electrolyte using single-phase current at a frequency of 80 to 120 Hz and in which the ratio of the anode time to the period is 0.25 to 0.20. The method requires a high level of complex circuitry due to the large amount of electrical power used which results in problems in the distribution of the current to the individual electrodes since it is difficult to design a connection of a pole to the printing plate support.

German Patent No. 3,842,454 C2 relates to a method for electrolytic surface roughening of an aluminum plate using a single-phase current. According to the disclosure, an electrically insulating organic or inorganic initial coating is formed on the aluminum plate before the electrolytic surface roughening. This method not only involves additional complexity to form this coating but also requires appropriate technical precautions due to the influence of non-sinusoidal single-phase currents used in the method. Even a very uniform initial coating does not prevent the formation of transverse strips, since the transverse strips are essentially caused by non-inear electrical characteristics of the surface of the printing plate support at the start of the roughening process.

German Patent No. 3,910,213 A1 describes roughening a support using a single-phase current at a higher, variable frequency which leads to a reduction in the intensity of the transverse strips. However, the method involves increased complexity of electrical facilities and limits the frequency range of the single-phase current which can be used for optimum structuring of the surface of the printing plate support.

Roughening of the printing plate support at specific transport speeds, such as those proposed in European Patent No. 585 586 B1, may result in constant action on each part of the printing plate support during the positive and negative half-cycles of the single-phase current. However, this ignores the fact that the transverse strips are essentially formed by the half-cycles present upon entering the zone of the single-phase roughening.

The known methods and devices attempt to account for or reduce the formation of the so-called transverse strips throughout the entire time when the printing plate support is passing through the single-phase roughening zone; however, prior methods do not prevent transverse strips from being formed at the point where the printing plate support enters the area in which the single-phase or three-phase electrodes operate.

The aim of combining mechanical and electrochemical roughening is to link the advantages of both methods together. It is expected that the roughened surface of the metal support will have finely superimposed wells and depressions, which are produced by the electrochemical roughening. It has unfortunately been found, however, that in addition to the pyramid-like structures from the mechanical roughening, relatively large holes occur as a result of the electrochemical roughening. A problem with electrochemical roughening using single-phase current or with the superimposition of electrochemical roughening by means of single-phase current on a mechanically roughened surface of a metal support at very high metal support processing speeds, is that the so-called electrical surface discharges occur in time with the single-phase voltage. These surface discharges are visible in the form of strips on the surface of the metal support. These disturbing surface discharges are caused by the continuous change in polarity of the single-phase voltage applied to the electrodes.

The surface discharges in the form of strips, also referred to as transverse strips or current strips, detract from the visual impression of the product. If the strips are particularly severely pronounced, the quality of the product may be affected as well. The formation of these transverse or current strips generally increases as the transport speed of the printing plate support increases. These strips are caused at the start of the roughening process by single-phase or three-phase current. The electrical behavior of the printing plate support and of the electrolyte at the start of the roughening process is non-linear, and varies as the roughening progresses. When the printing plate support enters the area in which the three-phase or single-phase electrodes separate, this non-linear behavior leads to the formation of the transverse strips, depending on whether the single-phase voltage was in a positive or negative half-cycle when the support entered the roughening zone.

SUMMARY OF THE INVENTION

An object of the invention is to overcome the disadvantages of the known art. Another object of the invention is to provide improved methods and apparatus for roughening a support such that the formation of current strips or transverse strips on the surface of the plate support during the electrochemical roughening, using a three-phase or single-phase current and transporting a support through an electrolyte bath, is prevented or minimized.

Yet not another object of the invention is to provide a specific structure and uniform nature of the surface of the support used for water retention and for the adhesion of the radiation-sensitive coating.

The foregoing object and other objects will be readily apparent to those skilled in the art and can be achieved in accordance with the present invention by roughening a support for radiation-sensitive coatings where the surface is subjected to chemical roughening or mechanical roughening in combination with electrochemical roughening. The electrochemical roughening is carried out by transporting the support through an aqueous electrolyte bath while applying a voltage to a three-phase or single-phase electrodes which face the support as it is transported through the electrolyte bath. A DC voltage is applied to the support before the support is transported past, or a portion of the support begins to be transported past, the electrodes.

In another embodiment of the present invention, a support is roughened by connecting the negative pole of a DC source is to the support, and connecting its positive pole to a DC electrode which faces the support. In a further embodiment, the negative pole of a DC source is connected to a DC electrode which faces the support, and the positive pole is connected to the support.

A further embodiment of the present invention includes a method for roughening a support wherein the DC voltage is applied to two DC electrodes, a first DC electrode being located upstream of the three-phase electrodes and the second DC electrode may be located between the three-phase electrodes or downstream of the three-phase electrodes.

A further embodiment of the invention includes a method for roughening a support where the DC voltage is applied by two DC electrodes arranged alongside one another, with the electrodes being insulated from one another.

A further embodiment of the invention includes a method for roughening a support where the roughened support is subsequently anodized in an anodizing bath.

Another aspect of the invention provides an apparatus for roughening a support which includes three-phase electrodes in an electrolyte bath connected to the secondary of a three-phase transformer, whose primer is connected via control transformers to a three-phase power transformer. A DC source is furthermore provided whose poles are connected to two DC electrodes or to one DC electrode and the support which moves past the three-phase and DC electrodes. In the present invention, the DC electrode may be arranged upstream of the first three-phase electrode in the direction in which the support is transported in the electrolyte bath, and is connected to the positive pole of the DC source whose negative pole is in contact with the support.

Another embodiment includes an apparatus for roughening a support where the two single-phase electrodes in an electrolyte bath are connected to a primary winding and to a secondary winding of a single-phase transformer. The positive pole of a DC source is connected to a DC electrode while the ground pole of the DC source is connected to a common connection of the primary winding and secondary winding. The DC electrode may be arranged upstream of the single-phase electrodes in the direction in which the support is transported.

The above and other advantages and features of the invention will be more clearly understood from the following detailed description which is provided in connection with the accompanying drawings.

BRIEF DESCRIPTION OF THE DRAWINGS

FIG. 5 shows a fifth embodiment of the apparatus, in which a DC electrode is connected upstream of the three-phase electrodes, and a supply for electrical current to an anodizing bath is connected to one pole of the DC source.

FIG. 6 shows a sixth embodiment of an apparatus according to the invention, in which two single-phase electrodes interact with a DC electrode.

DETAILED DESCRIPTION OF THE PREFERRED EMBODIMENT

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized, and that changes may be made without departing from the spirit and scope of the present invention.

Figure 1:
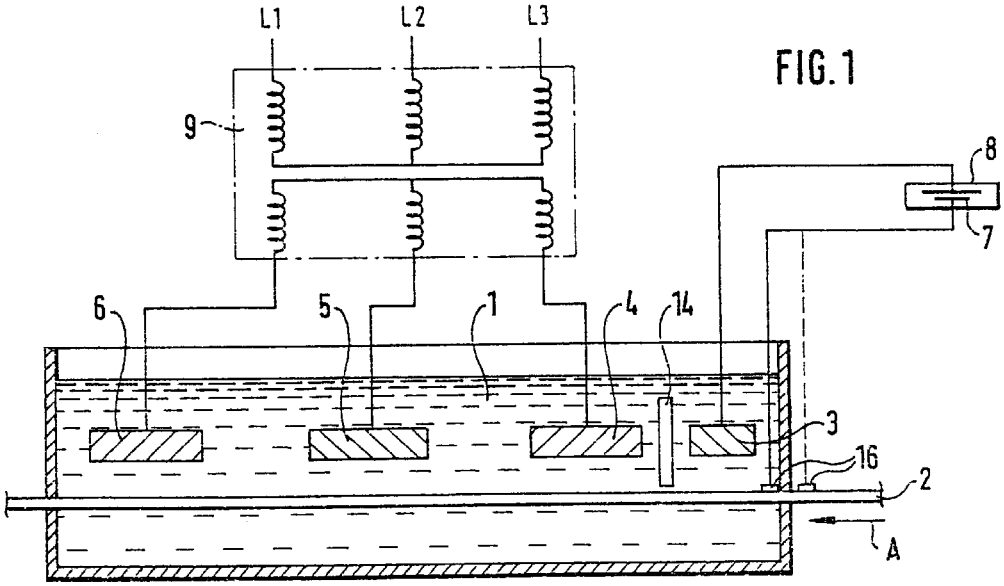
FIG. 1 shows, schematically, a first embodiment of an apparatus according to the invention, in which a DC electrode is connected upstream of the electrodes to which three-phase current is applied.

The invention will now be described with reference to the figures. FIG. 1 shows, schematically, an apparatus having an electrolyte bath 1 through which a support 2 in the form of a strip moves in the direction A of transport. The electrolyte in the electrolyte bath 1 may be, for example, a dilute aqueous nitric, sulfuric or hydrochloric acid. Combinations of two or three acids may also be used. Other acid baths with which a person skilled in the art is familiar are, of course, also suitable for use in the electrolyte bath 1. Apart from acids, the electrolyte bath may also contain other chemicals, such as salts or surfactants.

Before entering the electrolyte bath 1, the support 2 is mechanically roughened or chemically pretreated in a suitable form. The devices for mechanical roughening of the surface of the support 2 are not shown. Such systems or devices are described and illustrated, inter alia, in German Patent No. 1,962,729 and German Patent Specification No. 1,962,728, the entirety of which are herein incorporated by reference.

Prior to the electrochemical roughening process, the support may be pretreated by an acid or alkaline initial scouring agent, to remove contaminants such as rolling oil, or "natural" oxide formed from the air. The device used for this purpose is not shown but is known to those of skill in the art. Electrochemical roughening of the surface of the support 2 takes place in the electrolyte bath 1 as the support 2 passes through the electrolyte bath 1.

Electrodes 4, 5, 6 are arranged, preferably, at a distance from the support 2 in the electrolyte bath 1 and are connected to three windings on the secondary of a three-phase transformer 9. The corresponding three windings on the primary of the three-phase transformer 9 are connected via cables L1, L2, L3 to control transformers (not shown). The control transformer may be fed from a common three-phase power transformer. Cables L1, L2, L3 may alternatively be connected directly to the power transformer, dispensing with the control transformers.

As described above, if no further measures are taken, then electrical discharges or electrical surface discharges result when the support 2 is transported at high speeds. While not wishing to be bound by theory, it is believed that these discharges are caused by the applied three-phase current, corresponding to the plurality changes at the three-phase electrodes 4, 5, 6.

In order to avoid these surface discharges, a DC electrode 3 is provided in the electrolyte bath 2 and connected upstream of the three-phase electrodes 4, 5, 6 in the direction A in which the support travels through the electrolyte bath. While the support 2 is depicted in the figures as travelling in the direction A from right to left on the page, it should be understood that the invention is not so limited. The DC electrode 3 is connected to the positive pole of a DC source 8. The ground pole or negative pole 7 of the DC source 8 makes direct contact with the support 2, for example, by a contact roller or a wiper. Insulation 14 is located between the DC electrode 3 and the three-phase electrode 4.

The support 2 is moved continuously past the electrodes 3, 4, 5 and 6 at a specific distance from them and in the direction of transport indicated by the arrow A. While the support moves past electrodes 3, 4, 5, 6, single-phase current flows through the support 2. Direct current flows into the support 2 via DC electrode 3. This direct current changes the surface of the support, even before it enters the area in which the three-phase electrodes 4, 5, 6 act, to such an extent that transverse strips are not formed by the positive and negative half-cycles of the three-phase current. The contact between the negative pole 7 and the support 2 is illustrated in the figure as being made within the electrolyte bath 1, it should be understood, however, that this contact may also be provided outside the electrolyte bath 1. It is likewise optionally possible for the negative pole 7 of the DC source 8 to be connected to the DC electrode 3. Additionally, the positive pole can be alternatively connected to the support 2. The DC electrode 3 is, in this case, positioned sufficiently close to the first three-phase electrode 4 such that it is difficult, before the three-phase or single-phase current starts to act, for there to be any change from the electrical behavior of the surface of the support 2 achieved downstream of the electrode 3.

The current density of the three-phase electrodes 4, 5 and 6, which are operated with a variable three-phase frequency for purely electrochemical roughening, is generally in the range from about 50 to about 200 A/dm$^2$. After completion of the electrochemical roughening in the electrolyte bath, the support 2 may be rinsed and electrochemically anodized.

The rinsing process may be carried out either with or without intermediate scouring. The voltages applied to electrodes 4, 5, 6 are generally from about 1 to about 50 V, preferably from about 20 to about 40 V.

The direct current applied to the electrode 3 can generally vary in the range from about 0.1 to about 10% of the roughening current of all the single-phase electrodes. Preferably the direct current is about 2% of the roughening current. The voltage of the applied direct current is generally from about 1 to about 30 V, preferably from about 5 to about 10 V. The current density of the direct current is from about 3% to about 300% of that of the roughening current of all the roughening electrodes, preferably 100% of that of the roughening current.

Figure 2:
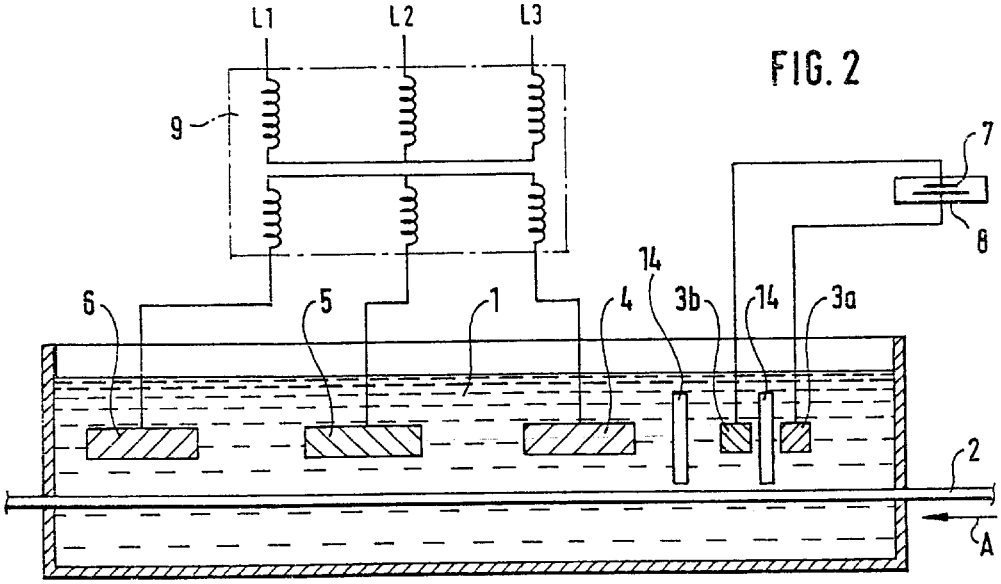
FIG. 2 shows, schematically, a second embodiment of the apparatus, in which two DC electrodes are connected upstream of the three-phase electrodes.

A second embodiment of the apparatus is shown in FIG. 2. The apparatus includes an electrolyte bath 1 through which the support 2 is transported. The electrolyte bath 1 contains an electrolyte which may include the same constituents as the electrolyte bath described above with reference to FIG. 1. In addition to the three-phase electrodes 4, 5 and 6, two DC electrodes 3*a* and 3*b* are immersed in the electrolyte bath 1. The DC electrodes 3*a*, 3*b* are arranged upstream from the three-phase electrodes 4, 5 and 6 in the direction A in which the support 2 is transported. Insulation 14 is formed between the two DC electrodes 3*a* and 3*b*, on the one hand, and between the DC electrode 3*b* and the three-phase electrode 4 on the other hand. The DC electrode 3*a* is connected to the positive pole of a DC source 8, while the DC electrode 3*b* is connected to the negative or ground pole 7 of a DC source 8. The three-phase electrodes 4, 5 and 6 are connected to corresponding windings on the secondary of a three-phase transformer 9. The windings on the primary of the three-phase transformer 9 are connected to a three-phase supply via any known regulator transformers (not shown) and via any known power transformer (not shown). For example, the three-phase transformer may be star- or delta-connected. The three-phase control transformers are connected to the power transformer via the cables L1, L2 and L3. Three-phase current is supplied via the cables L1, L2 and L3.

Figure 3:
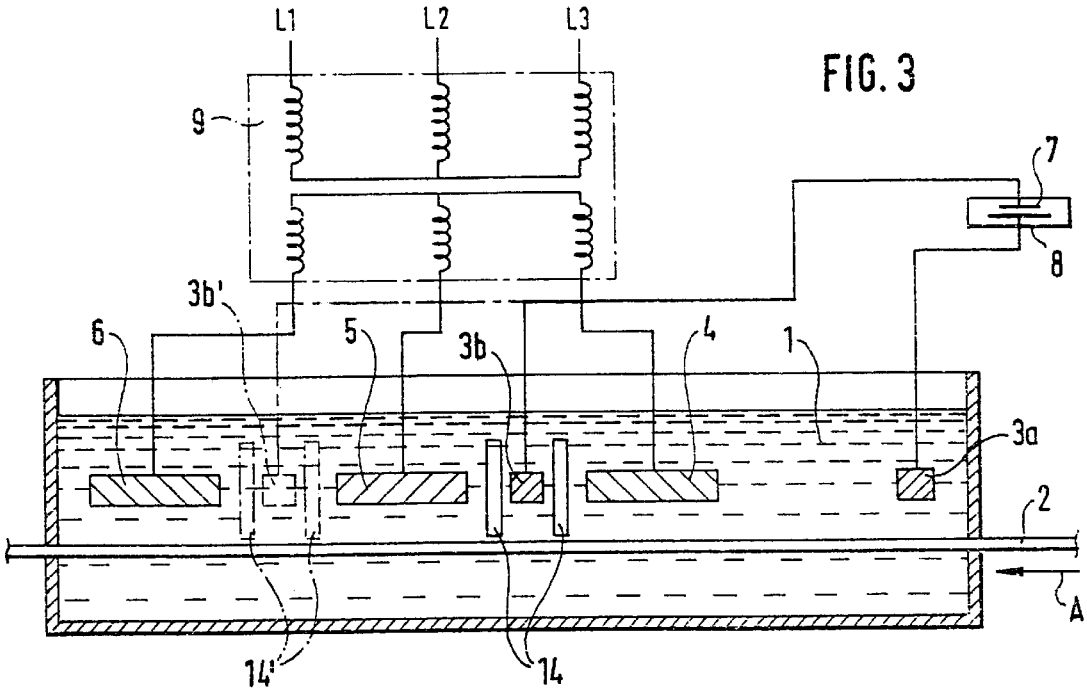
FIG. 3 shows, schematically, a third embodiment of the apparatus, in which a DC electrode is connected upstream of the three-phase electrodes, while a further DC electrode is arranged between the three-phase electrodes.

A third embodiment of the present invention is illustrated schematically in FIG. 3. The third apparatus differs from the second embodiment shown in FIG. 2 in that the two DC electrodes 3*a* and 3*b* are arranged separately from one another in the electrolyte bath 1, as opposed to being alongside one another as shown in FIG. 2. As discussed above with reference to FIG. 2, the three-phase electrodes 4, 5 and 6 in the third embodiment are connected to the corresponding windings on the secondary of the three-phase transformer 9. Corresponding windings on the primary of the three-phase transformer are connected to a three-phase supply via control transformers (not shown) and a power transformer (not shown). The control transformers and the power transformer are connected via cables L1, L2 and L3. Three-phase current is supplied via the cables L1, L2 and L3. A first DC electrode 3*a* is arranged upstream of the first three-phase electrode 4 in the direction A in which the support 2 is transported. The second DC electrode, 3*b* or 3*b*', is located between the first and the second three-phase electrode 4, 5 (3*b*) or may be alternatively located between the second and the third three-phase electrode 5, 6, (3*b*') as is indicated by dashed lines in FIG. 3. DC electrode 3*b* is, in each case, isolated from the adjacent three-phase electrodes by insulation 14. DC electrode 3*a* is connected to the positive pole of the DC source 8, and the DC electrode 3*b* or 3*b*' is connected to the negative pole 7.

Figure 4:
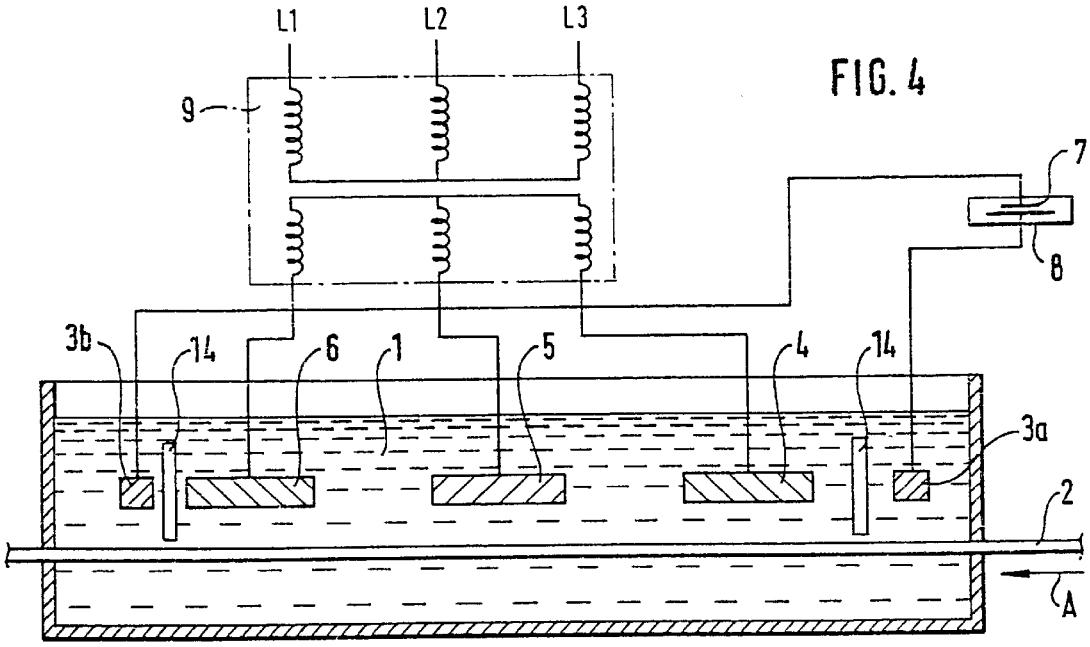
FIG. 4 shows, schematically, a fourth embodiment, in which a DC electrode is arranged upstream and downstream of the three-phase electrodes.

In a fourth embodiment of the present invention, which is illustrated schematically in FIG. 4, the three-phase electrodes 4, 5 and 6 are connected as described above with reference to FIGS. 2 and 3. A first DC electrode 3*a* is arranged in the electrolyte bath 1 upstream of the first three-phase electrode 4. The second DC electrode 3*b* is arranged in the electrolyte bath 1 downstream of the third three-phase electrode 6 as seen in the direction A in which the support 2 is transported. The support 2 passes through an electrolyte bath 1, which may have the same constituents as the electrolyte baths described above with reference to FIGS. 1 to 3. The DC electrode 3*a* is connected to the positive pole of the DC source 8, and the DC electrode 3*b* is connected to its negative pole 7. Insulation 14 is placed between DC electrode 3*a* and the three-phase electrode 4, and also between the three-phase electrode 6 and DC electrode 3*b*.

Reference is now made to FIG. 5. This figure schematically shows a fifth embodiment of the present invention. The support 2 passes through the electrolyte bath 1 in the direction A of transport. The surface of the support 2 is electrochemically roughened in the electrolyte bath 1. Support 2 then passes through an anodizing bath 13 where it is electrochemically anodized or oxidized. DC electrode 3 and three-phase electrodes 4, 5 and 6 are arranged in the electrolyte bath 1, in the direction A in which the support 2 is transported. The three-phase electrodes 4, 5 and 6 are connected to the secondary windings of a three-phase transformer 9 as described above with reference to FIGS. 1 to 4. The DC electrode 3 is connected to the positive pole of a DC voltage source 8. Two electrodes 20, and 21, to which electricity is applied, are located in the anodizing bath 13. The negative pole of the DC current source is connected to one supply for electrical current, which is not shown in any more detail, for the anodizing bath 13. Insulation 14 is placed between the DC electrode 3 and the three-phase electrode 4. Insulation 14 may also be located between the electrodes of the anodizing bath 13. The distribution and magnitude of the direct current applied to the support 2 is governed by the condition of the support 2 and of the electrolyte in the electrolyte bath 1. As described herein, the second to fifth embodiments of the apparatus according to the invention do not require contact to be made with the moving support 2.

Reference is now made to FIG. 6. This figure illustrates a sixth embodiment of the present invention. According to this embodiment, direct current is applied to the support 2 in advance, even before it comes under the influence of the single-phase current. Two single-phase electrodes 10 and 11 are located in the electrolyte bath 1 and are connected, respectively, to primary winding U1 and secondary winding U2 of a single-phase transformer 12. DC electrode 3 is arranged upstream of the single-phase electrodes 10, 11 in the direction A in which the support 2 is transported through the electrolyte bath 1. DC electrode 3 is connected to the positive pole of a DC source 8. Insulation 14 is located between the DC electrode 3 and the single-phase electrode 10. The negative pole 7 of the DC source 8 is connected to a common connection 15 of the primary winding and secondary winding of the single-phase transformer 12. The connection 15 of the two windings U1 and U2 is at a mean potential, in which case the voltage of, in each case, one winding of the transformer is half the magnitude of the applied single-phase voltage. Inductances, resistances and capacitances can be connected to the output side of the single-phase transformer 12 in order to reduce the ripple on the direct current obtained in this way. The negative pole 7 of the DC source 8 is then connected to a point on the output side of the single-phase transformer 12 which is at the mean potential. In the case of a three-phase transformer, the potential of the neutral conductor of the three-phase transformer corresponds to the mean potential.

Figure 7A:
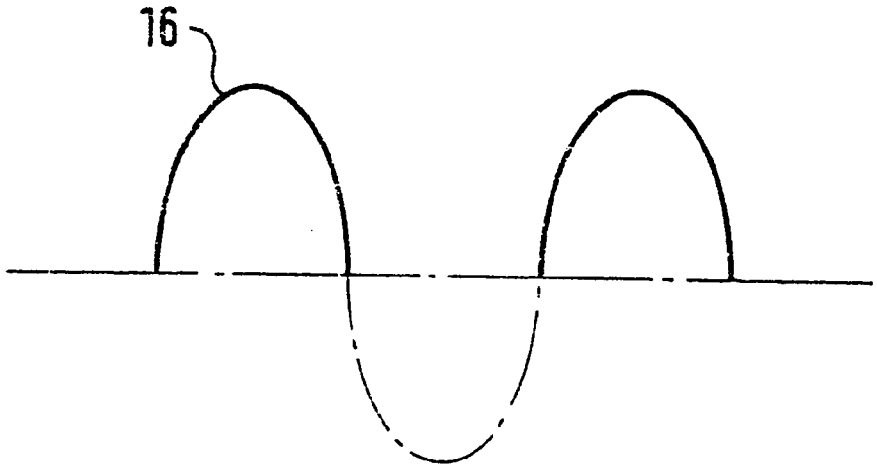
FIGS. 7*a* and 7*b* show, schematically, diagrams of pulsed direct currents which are applied to DC electrodes.
Figure 7B:
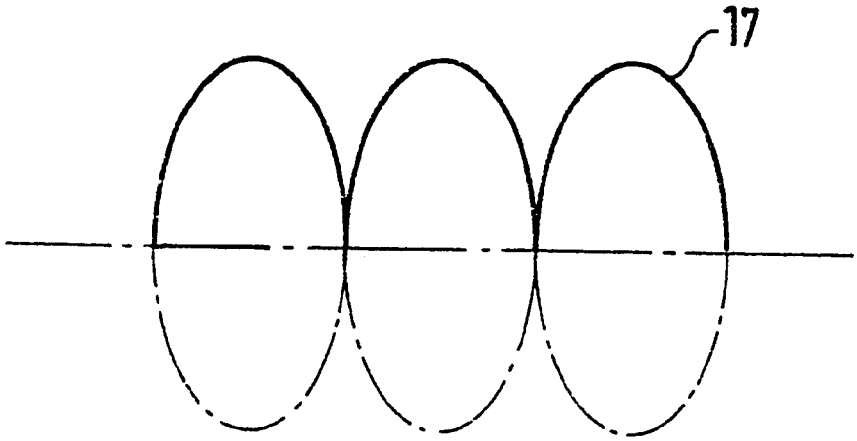

Rechargeable batteries, such as batteries, electrochemical elements, and unipolar machines supply pure direct current. In contrast, DC generators produce a pulsating direct current whose ripple is relatively low. Such pulsating direct currents are intrinsically mixed currents, which are composed of direct currents on which an alternating current is superimposed. In the case of the apparatuses according to the invention, such pulsating DC voltages can act on the support 2 instead of a pure DC voltage, as is shown schematically in FIGS. 7*a* and 7*b*. The pulsating DC voltage 16 illustrated in FIG. 7*a* is a voltage in which half of the AC voltage in each case flows as a pulsating DC voltage. Such a pulsating DC voltage is obtained if the load on the rectifier circuit of a transformer circuit is resistive. The pulsating DC voltage 17 illustrated in FIG. 7*b*, has considerably less ripple than the DC voltage shown in FIG. 7*a*. This voltage is obtained by a so-called neutral or two-way connection in a bridge circuit or full-wave rectifier circuit. The ripple can be reduced further by producing a pulsating DC voltage using a so-called three-phase star circuit or three-phase bridge circuit. The action of the pulsating DC voltage right at the start of the transport movement of the support 2 results in the surface of the support 2 being changed by the DC voltage elements to such an extent that the subsequent single-phase or three-phase effect at the start of the support movement is kept sufficiently low that current strips are not formed, or are formed in negligible amounts. Pure DC voltage may also be used according to the present invention.

The DC electrodes may be typically designed such that their electrically effective width is variable. The distance between the DC electrodes and the support, on the one hand, and the single-phase electrodes, on the other hand, is likewise variable, as is the voltage applied to the DC electrodes.

The invention will now be described with reference to the following examples. It should be understood that these examples are provided merely for illustration and should not be construed as limiting the present invention.

Comparison example

An aluminum strip (purity≧99.5% A1) is degreased and cleaned at room temperature in a 5% sodium lye, is then rinsed with water. The strip is then treated in a 1% hydrochloric acid solution using a single-phase current at a frequency of 50 Hz and with a current density of 100 A/dm$^2$, at a strip speed of 1 m/s. After passing through the roughening station, easily visibly light and dark strips, which alternate at a distance of 2 cm, can be observed across the strip movement direction.

EXAMPLE 1

An aluminum strip (purity≧99.5% A1) is cleaned in accordance with the comparison example using a 5% sodium lye solution and is then rinsed. Immediately before roughening with the single-phase current, the strip is first treated, in the hydrochloric acid solution described in the comparison example, under a DC voltage electrode connected to the positive pole of a DC source having a current density of 80 A/dm$^2$. The strip is then roughened with a single-phase current at a frequency of 50 Hz, with a current density of 100 A/dm$^2$ and at a strip speed of 1 m/s. After passing through the roughening station, a support of uniform brightness is obtained, which has no alternating light and dark strips across the strip movement direction.

EXAMPLE 2

An aluminum strip (purity≧99.5% A1) is cleaned in accordance with the comparison example using a 5% sodium lye solution and is then rinsed. Immediately before roughening with the single-phase current, the strip is treated in the hydrochloric acid solution described above under a DC voltage electrode, which is connected to the negative pole of a DC source, with a current density of 80 A/dm$^2$. The strip is then roughened with a single-phase current at a frequency of 50 Hz with a current density of 100 A/dm$^2$ and at a strip speed of 1 m/s. After passing through the roughening station, scarcely any visible alternating light and dark strips across the strip movement direction can be observed.

It should again be noted that although the invention has been described with specific reference to supports for radiation-sensitive coatings, the invention has broader applicability and may be used anywhere where electrochemical roughening is desired. Similarly, the process described above is but one method of many that could be used. Accordingly, the above description and accompanying drawings are only illustrative of preferred embodiments which can achieve the features and advantages of the present invention. It is not intended that the invention be limited to the embodiments shown and described in detail herein. The invention is only limited by the scope of the following claims.

What is claimed as new and desired to be protected by Letters Patent of the United States is

We claim:

1. A method for roughening a support for radiation-sensitive coatings, comprising:

providing an chemically or mechanically roughened support;

providing an aqueous electrolyte bath having three-phase electrodes or a single phase electrode placed therein;

placing said support in said aqueous electrolyte bath to electrochemically roughen said support by applying three-phase or single-phase current to said electrodes which face the support; and passing said support continuously through the electrolyte bath, wherein a DC voltage is applied to the support before the support is transported past, or as the support starts to be transported past the three-phase electrodes or single-phase electrodes.

2. The method according to claim 1, wherein the negative pole of a DC source is connected to the support, and wherein the positive pole of the DC source is connected to a DC electrode which faces the support.

3. The method according to claim 1, wherein the negative pole of a DC source is connected to a DC electrode which faces the support, and the positive pole of the DC source is connected to the support.

4. The method according to claim 1, wherein the DC voltage is applied to two DC electrodes, the first electrode being arranged upstream of a three-phase electrode in the direction in which the support passes through said bath, and the second electrode being arranged between the three-phase electrodes.

5. The method according to claim 1, wherein the DC voltage is applied to two DC electrodes, the first electrode being located upstream of a three-phase electrode in the direction in which the support passes through said bath, and wherein the second DC electrode is located downstream of the three-phase electrodes.

6. The method according to claim 1, wherein the DC voltage is applied to two DC electrodes which are arranged alongside one another upstream of a three-phase electrode in the direction in which the support passes through said bath, and wherein the two DC electrodes are insulated from one another.

7. The method according to claim 1, further comprising passing said support through an anodizing bath after roughening said support, said support being anodized in an anodizing bath by electric current, wherein a DC voltage is applied to a DC electrode arranged upstream of said three-phase electrodes in the direction in which the support passes through said electrolyte bath, and wherein said DC voltage supplies an electric current to the anodizing bath.

8. The method according to claim 1, wherein a DC voltage is applied to a DC electrode and to a three-phase or single-phase transformer;

said DC electrode being located upstream of a three-phase or single-phase electrode in the direction in which the support passes through said electrolyte bath;

said DC electrode being connected to the positive pole of the DC source; and wherein the negative pole of said DC source is connected to the middle phase of the three-phase transformer, or to a neutral point of the single-phase voltages of two windings of a single-phase transformer.

9. The method according to claim 8, wherein said single-phase transformer is connected such that one connection of the primary winding and one connection of the secondary winding have a common connection, wherein the negative pole of said DC source being connected to this common connection.

10. The method according to claim 1, wherein the DC voltage is pulsed, and wherein the positive half-cycles of the pulsed DC voltage are applied to said support.

11. The method according to claim 1, wherein the DC voltage is pulsed, and wherein at least a portion of the positive half-cycles of the pulsed DC voltage are applied to the support.

12. An apparatus for roughening a support comprising:

an aqueous electrolyte bath;

a plurality of three-phase electrodes placed in said electrolyte bath;

said three-phase electrodes being connected to the secondary of a three-phase transformer wherein the primary of said three-phase transformer is connected, via control transformers, to a three-phase power transformer;

at least one DC electrode; and a DC source whose poles are connected to two DC electrodes or to one DC electrode and the support.

13. The apparatus according to claim 12, wherein a DC electrode is arranged upstream of a first three-phase electrode in the direction in which said support is transported in said electrolyte bath, said DC electrode being connected to the positive pole of the DC source, the negative pole of said DC source being is in contact with said support.

14. The apparatus according to claim 12, wherein two DC electrodes are arranged upstream of a first three-phase electrode in the direction in which the support is transported through said electrolyte bath, and wherein insulation is formed between said two DC electrodes.

15. The apparatus according to claim 12, wherein a first DC electrode is arranged upstream of a first three-phase electrode in the direction in which the support is transported through said electrolyte bath, and wherein a second DC electrode is located between a first and second three-phase electrode.

16. The apparatus according to claim 12, wherein a first DC electrode is arranged upstream of a first three-phase electrode in the direction in which the support is transported through said electrolyte bath, and wherein a second DC electrode is located between a second and a third three-phase electrode.

17. The apparatus according to claim 12, wherein a first DC electrode is arranged upstream of a first three-phase electrode, and a second DC electrode is arranged downstream of a third three-phase electrode.

18. The apparatus according to claim 12, wherein a DC electrode is arranged upstream of a first three-phase electrode in the direction in which the support is transported through said electrolyte bath, and wherein said DC electrode is connected to the positive pole of the DC source, and wherein the negative pole of said DC source is connected to a supply for electric current to an anodizing bath.

19. An apparatus for roughening a support, said apparatus comprising:

an aqueous electrolyte bath;

two single-phase electrodes in said electrolyte bath, wherein said electrodes are connected to a primary winding and to a secondary winding of a single-phase transformer;

at least one DC electrode; and a DC source, wherein the positive pole of said DC source is connected to a DC electrode and the negative pole of said DC source is connected to a common connection of the primary winding and secondary winding.

20. The apparatus according to claim 19, wherein the DC electrode is arranged upstream of said single-phase electrodes in the direction in which the support is transported.

* * * * *